US009905180B2

(12) United States Patent
Lin et al.

(10) Patent No.: US 9,905,180 B2
(45) Date of Patent: Feb. 27, 2018

(54) GATE DRIVING CIRCUIT AND DISPLAY MODULE

(71) Applicant: Sitronix Technology Corp., Hsinchu County (TW)

(72) Inventors: Tsun-Sen Lin, Hsinchu County (TW); Min-Nan Liao, Hsinchu County (TW)

(73) Assignee: Sitronix Technology Corp., Hsinchu (TW)

( * ) Notice: Subject to any disclaimer, the term of this patent is extended or adjusted under 35 U.S.C. 154(b) by 359 days.

(21) Appl. No.: 14/880,294

(22) Filed: Oct. 12, 2015

(65) Prior Publication Data

US 2016/0275883 A1 Sep. 22, 2016

Related U.S. Application Data

(60) Provisional application No. 62/135,727, filed on Mar. 20, 2015.

(51) Int. Cl.
*G09G 3/36* (2006.01)

(52) U.S. Cl.
CPC ... *G09G 3/3677* (2013.01); *G09G 2310/0289* (2013.01)

(58) Field of Classification Search
CPC ... G09G 2300/0871; G09G 2300/0838; G09G 2310/0286; G09G 2310/0289; G09G 3/3677; G09G 3/36
See application file for complete search history.

(56) References Cited

U.S. PATENT DOCUMENTS

2004/0125065 A1* 7/2004 Park ..... G09G 3/20 345/92
2005/0206635 A1* 9/2005 Hashimoto ..... G09G 3/3614 345/204
2015/0078096 A1 3/2015 Kawasaki

FOREIGN PATENT DOCUMENTS

| | | |
|---|---|---|
| TW | 200518456 | 6/2005 |
| TW | 200703197 | 1/2007 |
| TW | 200725517 | 7/2007 |
| TW | 200727587 | 7/2007 |
| TW | 201110551 A1 | 3/2011 |
| TW | 201501468 A | 1/2015 |

* cited by examiner

*Primary Examiner* — Lun-Yi Lao
*Assistant Examiner* — Jarurat Suteerawongsa
(74) *Attorney, Agent, or Firm* — Winston Hsu

(57) ABSTRACT

A gate driving circuit for providing a scan signal to a LCD panel is disclosed. The gate driving circuit includes at least one positive level shifter, at least one negative level shifter, a pair of P-type transistor and an N-type transistor. The positive level shifter is utilized for shifting up agate control signal to generate a positive control signal. The negative level shifter is utilized for shifting down the gate control signal to generate a negative control signal. The pair of transistors is utilized for outputting a positive power voltage or a negative power voltage as the scan signal according to the positive control signal and the negative control signal. The positive power voltage minus the positive control signal is less than six volts. The negative control signal minus the negative power voltage is less than six volts.

12 Claims, 9 Drawing Sheets

GATE DRIVING CIRCUIT AND DISPLAY MODULE

CROSS REFERENCE TO RELATED APPLICATIONS

This application claims the benefit of U.S. Provisional Application No. 62/135,727 filed on Mar. 20, 2015, the contents of which are incorporated herein.

BACKGROUND OF THE INVENTION

1. Field of the Invention

The present invention is related to a gate driving circuit and display module, and more particularly, to a gate driving circuit and display module modulating the scan signal step by step.

2. Description of the Prior Art

A liquid crystal display (LCD) monitor has characteristics of light weight, low power consumption, zero radiation, etc. and is widely used in many information technology (IT) products, such as televisions, mobile phones, and laptop computers. The operating principle of the LCD monitor is based on the fact that different twist states of liquid crystals result in different polarization and refraction effects on light passing through the liquid crystals. Thus, the liquid crystals can be used to control amount of light emitted from the LCD monitor by arranging the liquid crystals in different twist states, so as to produce light outputs at various brightnesses.

Please refer to FIG. 1A, which is a schematic diagram of a thin film transistor (TFT) LCD monitor 10 of the prior art. The LCD monitor 10 includes an LCD panel 100, a source driver 102, a gate driver 104, a voltage generator 106 and a logic control circuit 116. The LCD panel 100 is composed of two substrates, and space between the substrates is filled with liquid crystal materials. One of the substrates is installed with a plurality of data lines 108, a plurality of scan lines (or gate lines) 110 and a plurality of TFTs 112, and another substrate is installed with a common electrode for providing a common signal Vcom outputted by the voltage generator 106. The TFTs 112 are arranged as a matrix on the LCD panel 100. Accordingly, each data line 108 corresponds to a column of the LCD panel 100, each scan line 110 corresponds to a row of the LCD panel 100, and each TFT 112 corresponds to a pixel. Note that the LCD panel 100 composed of the two substrates can be regarded as an equivalent capacitor 114.

The source driver 102 and the gate driver 104 input signals to the corresponding data lines 108 and scan lines 110 based upon a desired image data, to control whether or not to enable the TFT 112 and a voltage difference between two ends of the equivalent capacitor 114, so as to change alignment of the liquid crystals as well as the penetration amount of light. As a result, the desired image data can be correctly displayed on the LCD panel 100. The logic control circuit is utilized for coordinating the source driver 102 and the gate driver 104, such as calibrating timing of source driving signals on the data lines 108 and scan signals on the scan lines 110, such that the TFTs 112 are enabled by the scan signals and receive correct image data via the source driving signals at correct time instances.

Based on manufacturing requirements, components of the driving circuits of the LCD monitor 10 are mainly classified into low voltage devices, medium devices and high voltage devices. The low voltage devices are mainly employed in the logic control circuit 116, and an endurance limit for the low voltage devices is 1.5-1.8V. The medium voltage devices are mainly employed in the source driver 102, and an endurance limit for the medium voltage devices is 5-6 V. The high voltage devices are mainly employed in the gate driver 104, and an endurance limit for the high voltage devices is 25-30 V. Please refer to FIG. 1B, which is schematic diagram of a relationship curve for a conduction current and an operating voltage of a high voltage N-type transistor of the prior. Please also refer to FIG. 1C, which is schematic diagram of a relationship curve for a conduction current and an operating voltage of a high voltage P-type transistor of the prior. When the N-type transistor is enabled, an absolute value of a gate-to-source voltage difference |Vgsn| thereof is equal to 30 V. When the N-type transistor is disabled, the absolute value of the gate-to-source voltage difference |Vgsn| thereof is equal to 0 V. When the P-type transistor is enabled, an absolute value of a gate-to-source voltage difference |Vgsp| thereof is equal to 30 V. When the P-type transistor is disabled, the absolute value of the gate-to-source voltage difference |Vgsp| thereof is equal to 0 V. That is, a full voltage swing of the high voltage devices is 30 V, and the high voltage devices have to endure the full voltage swing without breakdown. Therefore, among the three device categories, the high voltage device require the largest layout area, the most masks and layers in the integrated circuit, and therefore cost the most.

For that reason, the industry focuses on how to employ less high voltage devices in the LCD driving circuits.

SUMMARY OF THE INVENTION

It is therefore a primary objective of the claimed invention to provide a gate driving circuit and a display module which require less high voltage devices.

The present invention discloses a gate driving circuit for providing a scan signal to a LCD panel, the gate driving circuit comprising at least one positive level shifter, electrically coupled in series, each for shifting up a gate control signal to generate a positive control signal; at least one negative level shifter, electrically coupled in series, each for shifting down the gate control signal to generate a negative control signal;

a P-type transistor, comprising a gate end, electrically coupled to the at least one positive level shifter, for receiving the positive control signal; a source end, for receiving a positive power voltage; and a drain end, electrically coupled to the LCD panel, for outputting the scan signal; and an N-type transistor, comprising a gate end, electrically coupled to the at least one negative level shifter, for receiving the negative control signal; a source end, for receiving a negative power voltage; and a drain end, electrically coupled to the drain end of the P-type transistor; wherein an absolute value of a voltage difference between the positive power voltage and the positive control signal is less than a medium voltage device endurance limit; wherein an absolute value of a voltage difference between the negative power voltage and the negative control signal is less than the medium voltage device endurance limit.

The present invention further discloses a gate driving circuit, for providing a scan signal to an LCD panel, the gate driving circuit comprising a positive level shifter, for shifting up a gate control signal to generate a first control signal; a capacitive coupling level shifter, electrically coupled to the positive level shifter, for shifting up the first control signal to generate a positive control signal; and shifting down the first control signal to generate a negative control signal; a P-type transistor, comprising a gate end, electrically coupled to the capacitive coupling level shifter, for receiving the positive control signal; a source end, for receiving a positive power voltage; and a drain end, electrically coupled to the LCD panel, for outputting the scan signal; and an N-type transistor, comprising a gate end, electrically coupled to the capacitive coupling level shifter, for receiving the negative control signal; a source end, for receiving a negative power voltage; and a drain end, electrically coupled to the drain end of the P-type transistor; wherein an absolute value of a voltage difference between the positive power voltage and the positive control signal is less than a medium voltage device endurance limit; wherein an absolute value of a voltage difference between the negative power voltage and the negative control signal is less than the medium voltage device endurance limit.

The present invention further discloses a display module, comprising an LCD panel; and a gate driving circuit, for providing a scan signal to the LCD panel, wherein the gate driving circuit comprises at least one positive level shifter, electrically coupled in series, each for shifting up a gate control signal to generate a positive control signal; at least one negative level shifter, electrically coupled in series, each for shifting down the gate control signal to generate a negative control signal; a P-type transistor, comprising a gate end, electrically coupled to the at least one positive level shifter, for receiving the positive control signal; a source end, for receiving a positive power voltage; and a drain end, electrically coupled to the LCD panel, for outputting the scan signal; and an N-type transistor, comprising a gate end, electrically coupled to the at least one negative level shifter, for receiving the negative control signal; a source end, for receiving a negative power voltage; and a drain end, electrically coupled to the drain end of the P-type transistor; wherein an absolute value of a voltage difference between the positive power voltage and the positive control signal is less than a medium voltage device endurance limit; wherein an absolute value of a voltage difference between the negative power voltage and the negative control signal is less than the medium voltage device endurance limit.

The present invention further discloses a display module, comprising an LCD panel; and a gate driving circuit, for providing a scan signal to the LCD panel, the gate driving circuit comprising a positive level shifter, for shifting up a gate control signal to generate a first control signal; a capacitive coupling level shifter, electrically coupled to the positive level shifter, for shifting up the first control signal to generate a positive control signal; and shifting down the first control signal to generate a negative control signal; a P-type transistor, comprising a gate end, electrically coupled to the capacitive coupling level shifter, for receiving the positive control signal; a source end, for receiving a positive power voltage; and a drain end, electrically coupled to the LCD panel, for outputting the scan signal; and an N-type transistor, comprising a gate end, electrically coupled to the capacitive coupling level shifter, for receiving the negative control signal; a source end, for receiving a negative power voltage; and a drain end, electrically coupled to the drain end of the P-type transistor; wherein an absolute value of a voltage difference between the positive power voltage and the positive control signal is less than a medium voltage device endurance limit; wherein an absolute value of a voltage difference between the negative power voltage and the negative control signal is less than the medium voltage device endurance limit.

These and other objectives of the present invention will no doubt become obvious to those of ordinary skill in the art after reading the following detailed description of the preferred embodiment that is illustrated in the various figures and drawings.

DETAILED DESCRIPTION

Figure 2A:
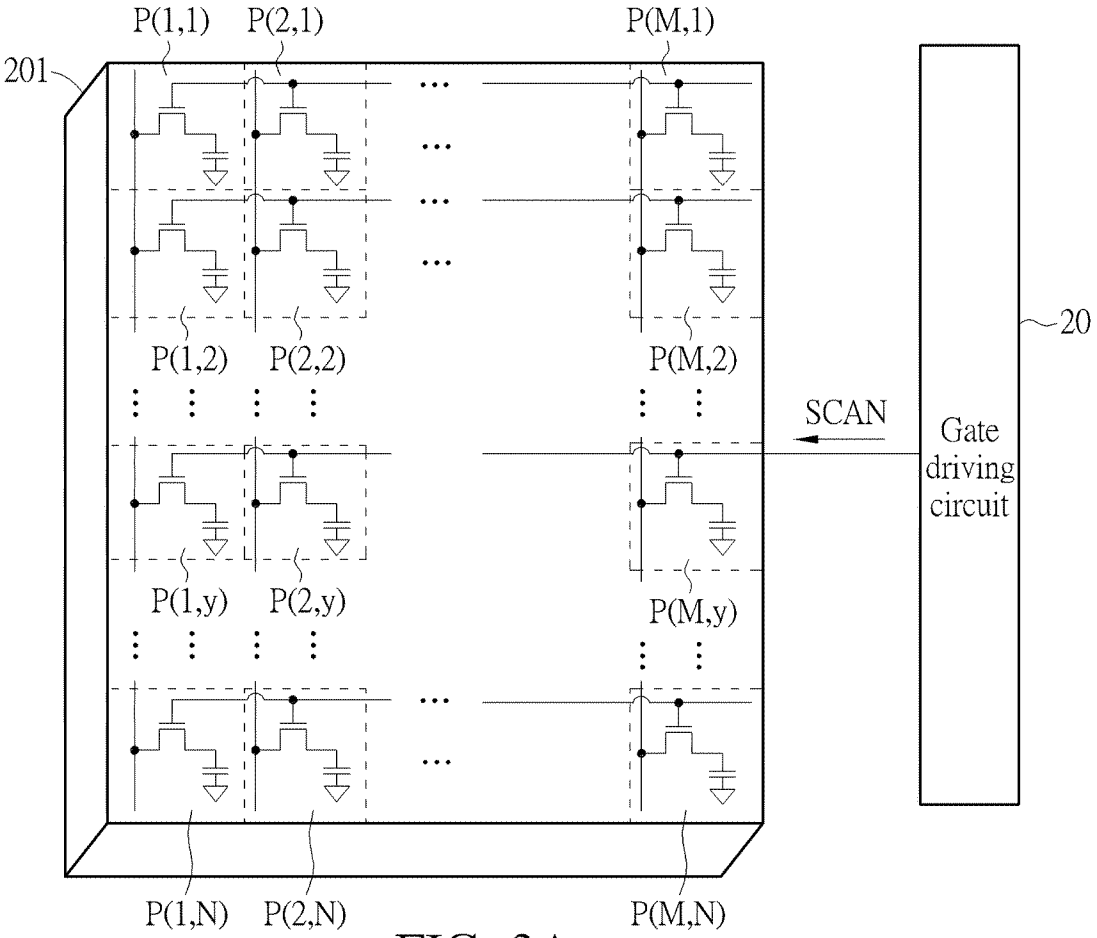
FIGS. 2A and 2B are schematic diagrams of a gate driving circuit according to an embodiment of the present invention.
Figure 2B:
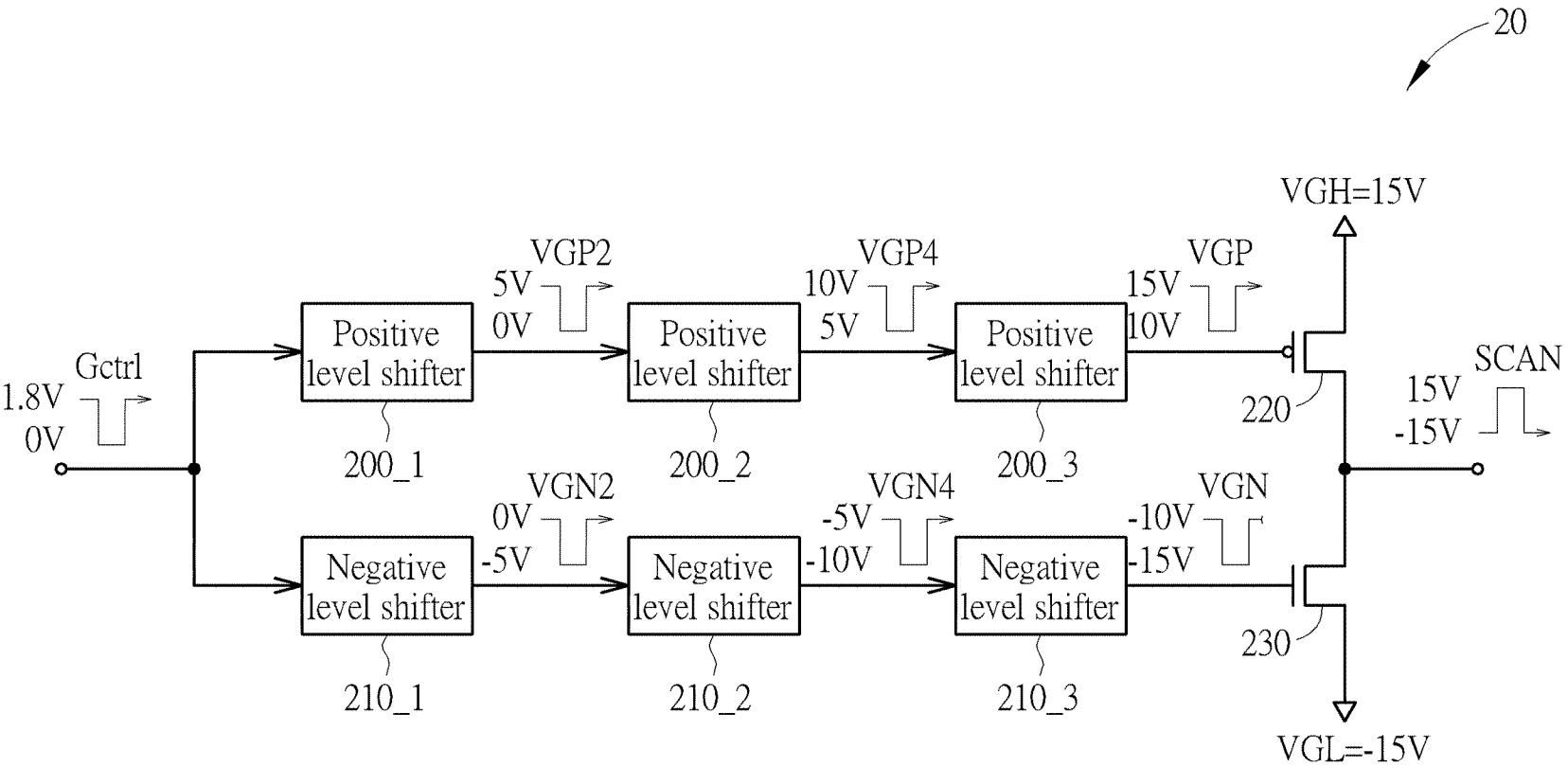

Please refer to FIGS. 2A and 2B, which are schematic diagrams of a gate driving circuit 20 according to an embodiment of the present invention. The gate driving circuit 20 is utilized for providing a scan signal SCAN to a liquid crystal display (LCD) panel 201. The LCD panel 201 includes a substrate and pixel units P(1,1)-P(M,N). The pixel units P(1,1)-P(M,N) are arranged in a matrix on the substrate. The scan signal SCAN is utilized for driving a row of pixel units on the LCD panel 201, such as the pixel units P(1, y)-P(M, y). The gate driving circuit 20 includes positive level shifters 200_1, 200_2, 200_3 and negative level shifters 210_1, 210_2, 210_3, a P-type transistor 220 and an N-type transistor 230. The positive level shifters 200_1, 200_2, 200_3 are coupled in series to shift up a gate control signal Gctrl step by step (first stage: 0/1.8 V→0/5V, second stage: 0/5 V→5/10 V, third stage: 5/10 V→10/15 V) to generate a positive control signal VGP. Similarly, the negative level shifters 210_1, 210_2, 210_3 are coupled in series to shift down the gate control signal Gctrl step by step (first stage: 0/1.8 V→0/−5 V, second stage: 0/−5 V→−5/−10 V, third stage: −5/−10 V→−10/−15 V) to generate a negative control signal VGN. Note that, the positive control signal VGP and the negative control signal VGN are different in level, but are identical in phase, such that the P-type transistor 220 and the N-type transistor 230 together function as an inverter, which generates the scan signal SCAN with an inverted phase in comparison with the positive control signal VGP and the negative control signal VGN. A logic "1" of the scan signal SCAN is provided by an external positive power voltage VGH, such as +15 V, and a logic "0" of the scan signal SCAN is provided by an external negative power voltage VGL, such as −15 V.

Figure 1A:
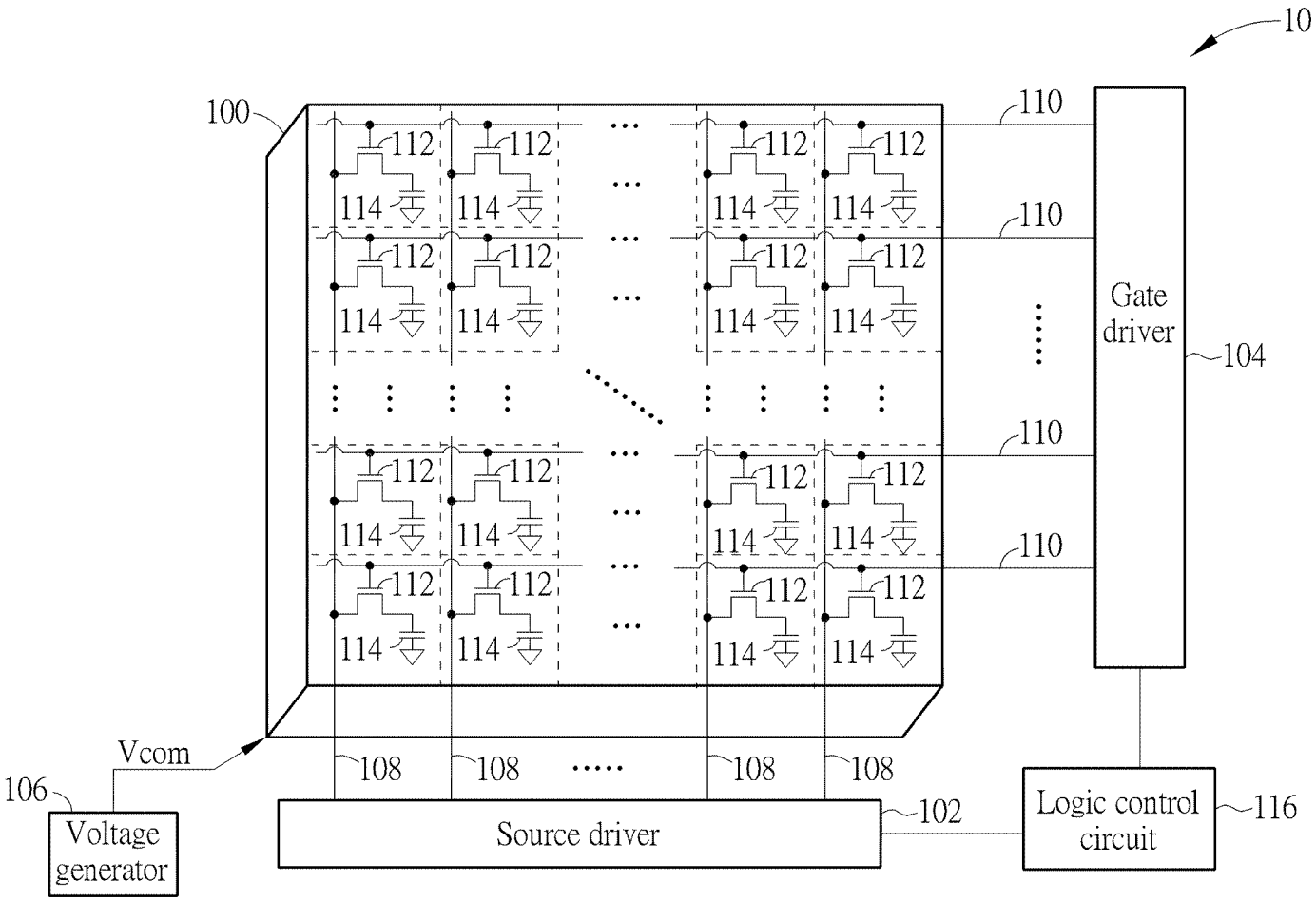
FIG. 1A PRIOR ART
FIG. 1A is a schematic diagram of a thin film transistor (TFT) LCD monitor of the prior art.
Figure 1B:
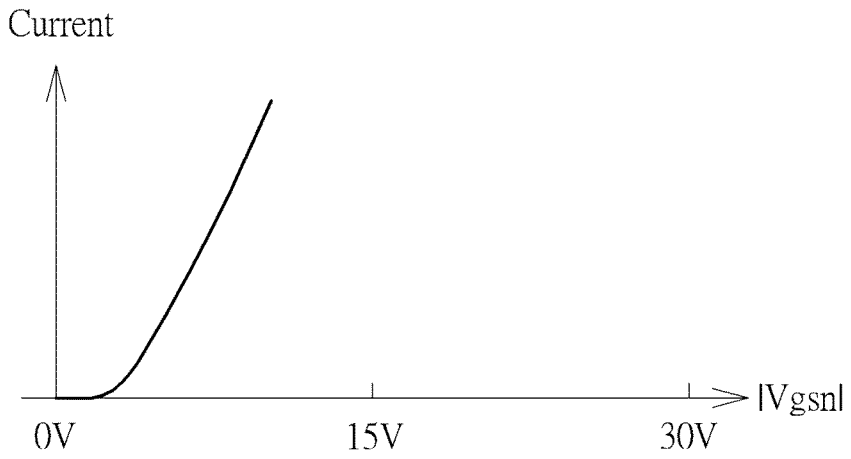
FIG. 1B PRIOR ART
FIG. 1B is schematic diagram of a relationship curve for a conduction current and an operating voltage of a high voltage N-type transistor of the prior.
Figure 1C:
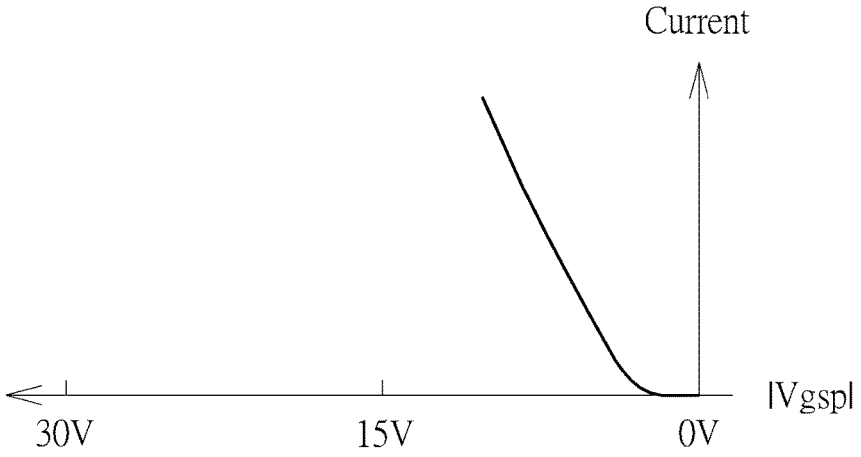
FIG. 1C PRIOR ART
FIG. 1C is schematic diagram of a relationship curve for a conduction current and an operating voltage of a high voltage P-type transistor of the prior.
Figure 3A:
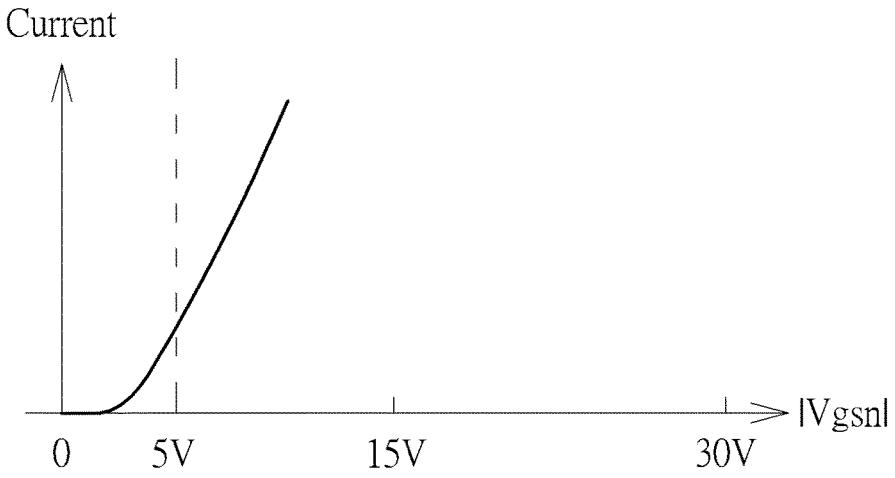
FIG. 3A is schematic diagram of a relationship curve for a conduction current and an operating voltage of an N-type transistor of the gate driving circuit of FIG. 2B.
Figure 3B:
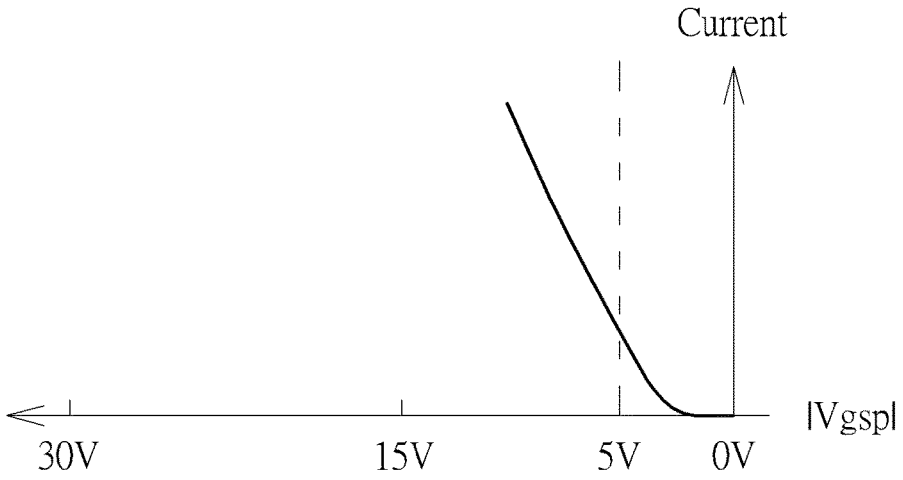
FIG. 3B is schematic diagram of a relationship curve for a conduction current and an operating voltage of a P-type transistor of the gate driving circuit of FIG. 2B.

Note that, since a voltage difference between the positive power voltage VGH and the positive control signal VGP is less than 6 V, an absolute value |Vgsp| of a gate-to-source voltage difference of the P-type transistor 220 is less than 6 V. Similarly, since a voltage difference between the negative control signal VGN and the negative power voltage VGL is less than 6 V, an absolute value |Vgsn| of a gate-to-source voltage difference of the N-type transistor 230 is less than 6 V. Please refer to FIG. 3A and FIG. 3B. FIG. 3A illustrate a relationship curve for a conduction current and an operating voltage of the N-type transistor 230. FIG. 3B illustrate a relationship curve for a conduction current and an operating voltage of the P-type transistor 220. According to FIG. 3A and FIG. 3B, the maximum operating voltages, i.e. |Vgsp| and |Vgsn| respectively, of the P-type transistor 220 and the N-type transistor 230 are 5 V. Therefore, the P-type transistor 220 and the N-type transistor 230 can be implemented by medium voltage devices instead of the high voltage devices of the prior art. In comparison, according to FIG. 1B and FIG. 1C of the prior art, the operating voltages of the transistors reach 30 V, and the transistors have to be implemented by high voltage devices. Therefore, the gate driving circuit 20 implemented by the medium voltage devices costs less as compared with the prior art.

In addition to the P-type transistor 220 and the N-type transistor 230, the positive level shifters 200_1, 200_2, 200_3 also can be implemented by medium voltage devices instead of the conventional high voltage devices. Specifically, please refer to FIG. 4, which are schematic diagrams of the positive level shifters 200_1, 200_2. The positive level shifter 200_1 is utilized for outputting a ground voltage VGND=0 V or a first power voltage VP1=5 V. Since a voltage difference between the first power voltage VP1 and the ground voltage VGND is less than 6 V, all component operating voltages of the positive level shifter 200_1 are less than 6V, and therefore the positive level shifter 200_1 can be implemented all by medium voltage devices. The positive level shifter 200_2 is utilized for outputting the first power voltage VP1=5 V or a second power voltage VP2=10 V. Similarly, since a voltage differences between the second power voltage VP2 and the first power voltage VP1 is less than 6 V, all component operating voltages of the positive level shifter 200_2 are less than 6V, and therefore the positive level shifter 200_2 can be implemented all by medium voltage devices.

In detail, the positive level shifter 200_1 includes P-type transistors QP1-QP4, N-type transistors QN1-QN4 and inverters 401, 402. When the gate control signal Gctrl is 1.8 V representing logic "1", and an inverted signal Gctrl' of the gate control signal Gctrl is 0 V representing logic "0", the N-type transistor QN1 and the P-type transistors QP2, QP4 are enabled, and the inverter 401 outputs a first inverted signal VGP2=5 V representing logic "1", and the inverter 402 outputs a second inverted signal VGP2'=0 V representing logic "0". On the contrary, when the gate control signal Gctrl=0 V representing logic "0", and the inverted signal Gctrl'=1.8 V representing logic "1", the N-type transistor QN2 and the P-type transistors QP1, QP3 are enabled, the first inverted signal VGP2=0 V representing logic "0", and the second inverted signal VGP2'=5V representing logic "1". Therefore, the positive level shifter 200_1 can shift up the gate control signal Gctrl of 0/1.8 V to generate the first inverted signal VGP2 of 0/5 V.

The positive level shifter 200_2 includes P-type transistors QP5-QP8, N-type transistors QN5-QN10 and inverters 403, 404. When the first inverted signal VGP2 is 5V representing logic "1", the N-type transistors QN5, QN7 and the P-type transistors QP5, QP8 are enabled, the inverter 404 outputs a fourth inverted a fourth inverted VGP4=10 V representing logic "1", and the inverter 403 outputs a third inverted signal VGP4'=5 V representing logic "0". On the contrary, when the first inverted signal VGP2 is 0V representing logic "0", the N-type transistors QN6, QN8 and the P-type transistors QP6, QP7 are enabled, the fourth inverted signal VGP4 is 5V representing logic "0", and the third inverted signal VGP4' is 10V representing logic "1". Therefore, the positive level shifter 200_2 can shift up the first inverted signal VGP2 of 0/5 V to generate the fourth inverted signal VGP4 of 5/10 V.

Figure 4:
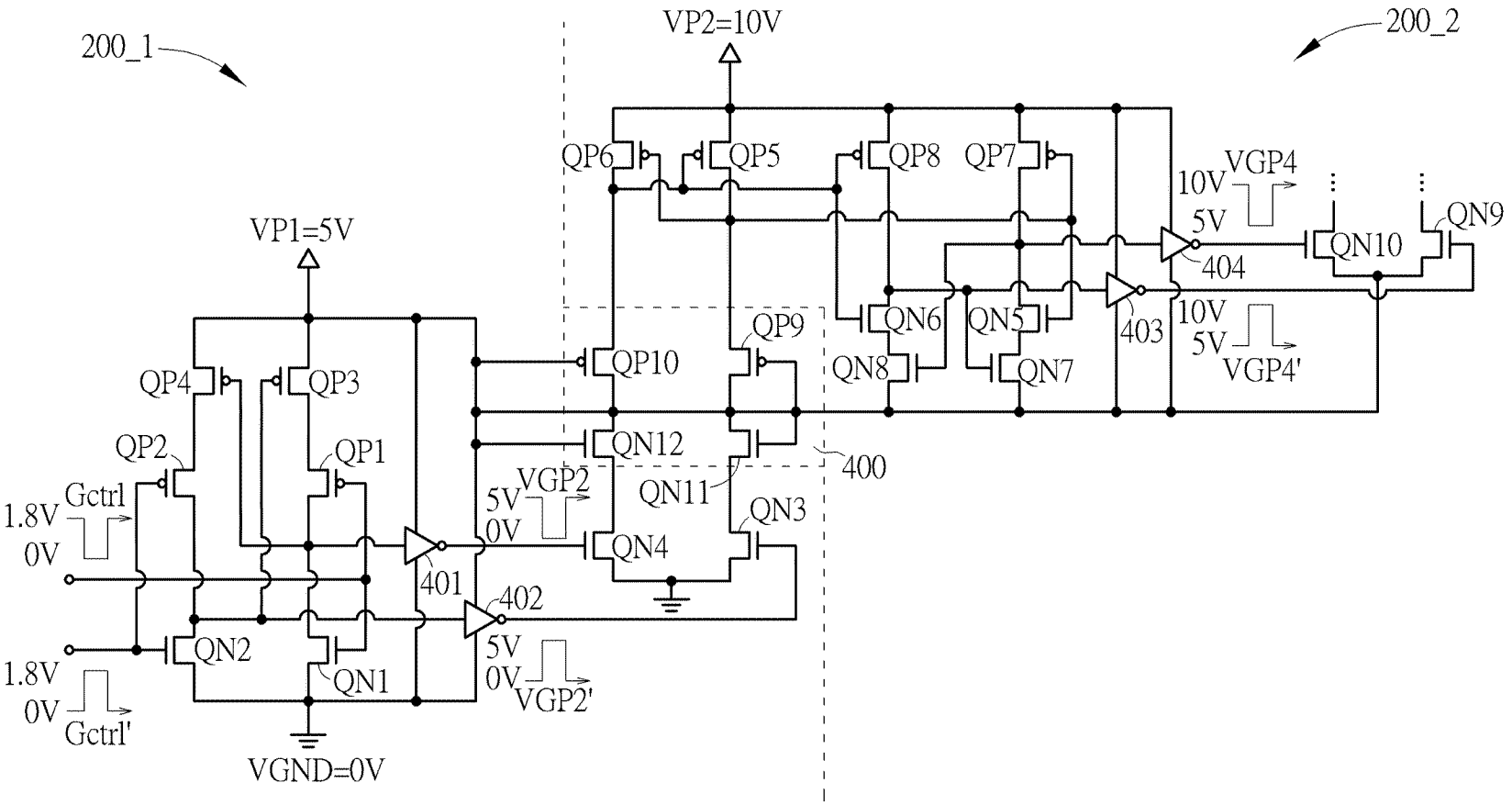
FIG. 4 is a schematic diagram of a positive level shifter of the gate driving circuit of FIG. 2B.

Note that, there is a voltage isolation circuit 400 between the positive level shifters 200_1, 200_2 in FIG. 4. The voltage isolation circuit 400 includes N-type transistors QN11, QN12 and P-type transistors QP9, QP10, and is utilized for isolating the ground voltage VGND and the second power voltage VP2. That is, the second power voltage VP2 would not appear in any node of the positive level shifter 200_1, and the ground voltage VGND would not appear in any node of the positive level shifter 200_2. As a result, all component operating voltages of the positive level shifters 200_1, 200_2 are less than 6 V, and the positive level shifters 200_1, 200_2 can be implemented all by medium voltage devices.

Similarly, the positive level shifter 200_3 can be implemented based on the positive level shifter 200_2, and shifts up the fourth inverted signal VGP4 of 5/10 V to generate the positive control signal VGP of 10/15 V. Details of the positive level shifter 200_3 are not further narrated herein.

Other than the positive level shifters 200_1, 200_2, 200_3, the negative level shifters 210_1, 210_2, 210_3 can also be implemented by medium voltage devices without any high voltage device. Specifically, please refer to FIG. 5, which is a schematic diagram of the negative level shifters 210_1, 210_2. The negative level shifter 210_1 is utilized for outputting the ground voltage VGND=0 V or a first power voltage VN1=−5 V. Since a voltage difference between the ground voltage VGND and the first power voltage VN1 is less than 6V, all component operating voltages of the negative level shifter 210_1 is less than 6 V, and the negative level shifter 210_1 can be implemented all by medium voltage devices. The negative level shifter 220 is utilized for outputting the first power voltage VN1=−5 V or a second power voltage VN2=−10 V. Similarly, since a voltage difference between the first power voltage VN1 and the second power voltage VN2 is less than 6V, all component operating voltages of the negative level shifter 210_2 is less than 6 V, and the negative level shifter 210_2 can be implemented all by medium voltage devices.

In detail, the negative level shifter 210_1 includes P-type transistors QP1'-QP4', N-type transistors QN1'-QN4' and inverters 501, 502. When the gate control signal Gctrl is equal to 1.8 V and represents logic "1", the N-type transistors QN1', QN3' and the P-type transistor QP2' are enabled, the inverter 501 outputs a first inverted signal VGN2=0 V representing logic "1", and the inverter 502 outputs a second inverted signal VGN2'=−5 V representing logic "0". Similarly, when the gate control signal Gctrl is equal to 0 V and represents logic "0", the N-type transistors QN2', QN4' and the P-type transistor QP1' are enabled, the first inverted signal VGN2 is −5 V representing logic "0", and the second inverted signal VGN2' is 0 V representing logic "1". Therefore, the negative level shifter 210_1 can shift down the gate control signal Gctrl of 0/5 V to generate the first inverted signal VGN2 of −5/0 V.

The negative level shifter 210_2 includes P-type transistors QP5'-QP10', N-type transistors QN5'-QN8' and inverters 503, 504. When the first inverted signal VGN2 is equal to 0 V and represents logic "1", the N-type transistors QN5', QN7' and the P-type transistors QP6', QP8' are enabled, the inverter 503 outputs a third inverted signal VGN4=−5 V representing logic "1", and the inverter 504 outputs a fourth inverted signal VGN4'=−10 V representing logic "0". On the contrary, when the first inverted signal VGN2 is equal to −5 V and represents logic "0", the N-type transistors QN6', QN8' and the P-type transistors QP5', QP7' are enabled, the third inverted signal VGN4 is −10 V representing logic "0", and the fourth inverted signal VGN4' is −5 V representing logic "1". Therefore, the negative level shifter 210_2 can shift down the first inverted signal VGN2 of −5/0 V to generate the third inverted signal VGN4 of −10/−5 V.

Figure 5:
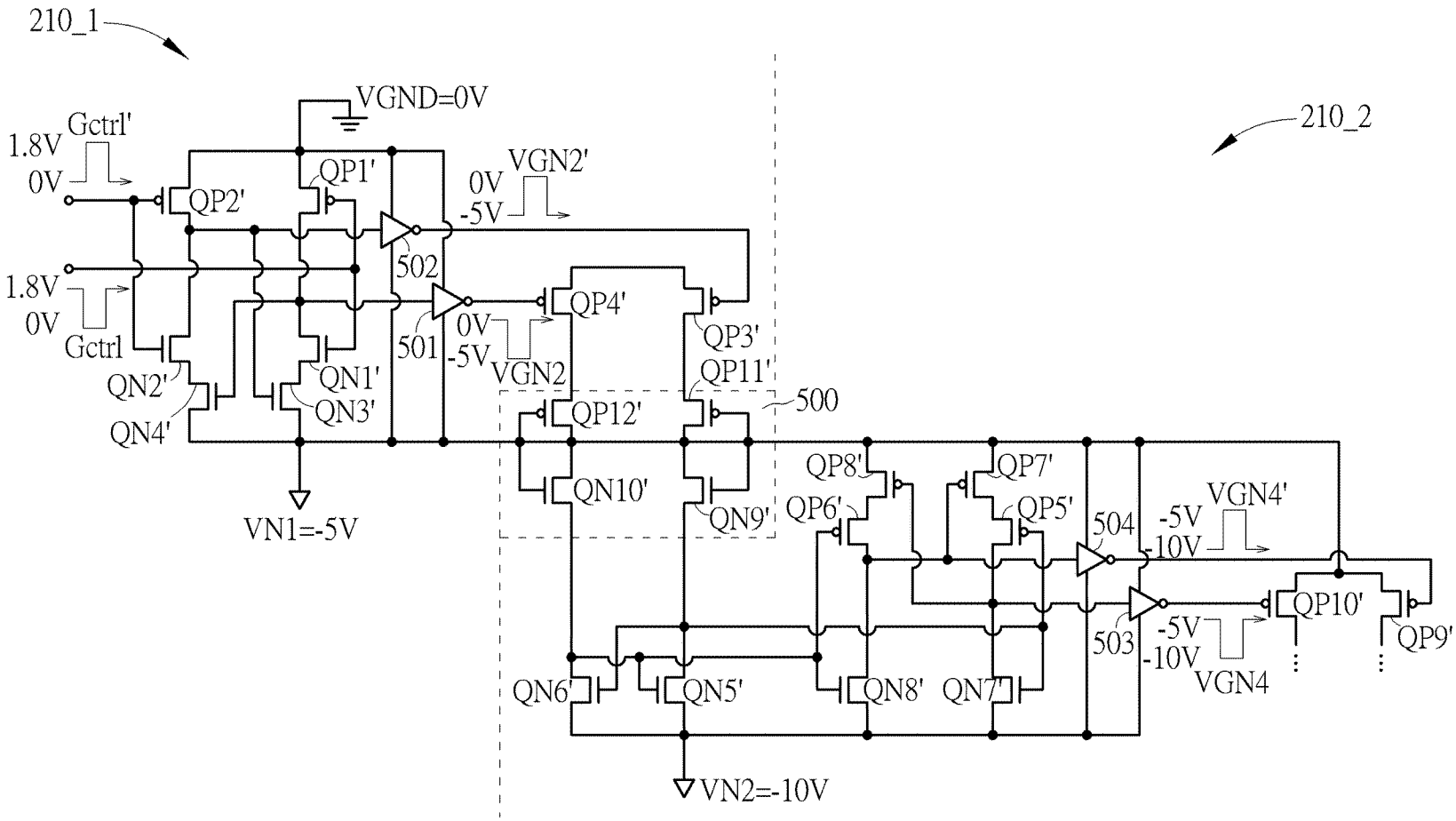
FIG. 5 is a schematic diagram of a negative level shifter of the gate driving circuit of FIG. 2B.

Note that, there is a voltage isolation circuit 500 between the negative level shifters 210_1, 210_2 in FIG. 5. The voltage isolation circuit 500 includes N-type transistors QN9', QN10' and P-type transistors QP11', QP12', and is utilized for isolating the ground voltage VGND and the second power voltage VN2. That is, the second power voltage VN2 would not appear in any node of the negative level shifter 210_1, and the ground voltage VGND would not appear in any node of the negative level shifter 210_2. As a result, all component operating voltages of the negative level shifters 210_1, 210_2 are less than 6 V, and the negative level shifters 210_1, 210_2 can be implemented all by medium voltage devices. Similarly, the negative level shifter 210_3 can be implemented based on the negative level shifter 210_2, and shifts down the third inverted signal VGN4 of −10/−5 V to generate the negative control signal VGN of −15/−10 V. Details of the negative level shifter 210_3 are not further narrated herein.

Note that, embodiments of FIGS. 2B, 4, 5 are designed with three circuit stages and voltage levels designed at 15, 10, 5, 0, −5, −10, −15 V. A skilled person in the art can modify the circuit stage number and the voltage levels based on practical requirements.

Figure 6:
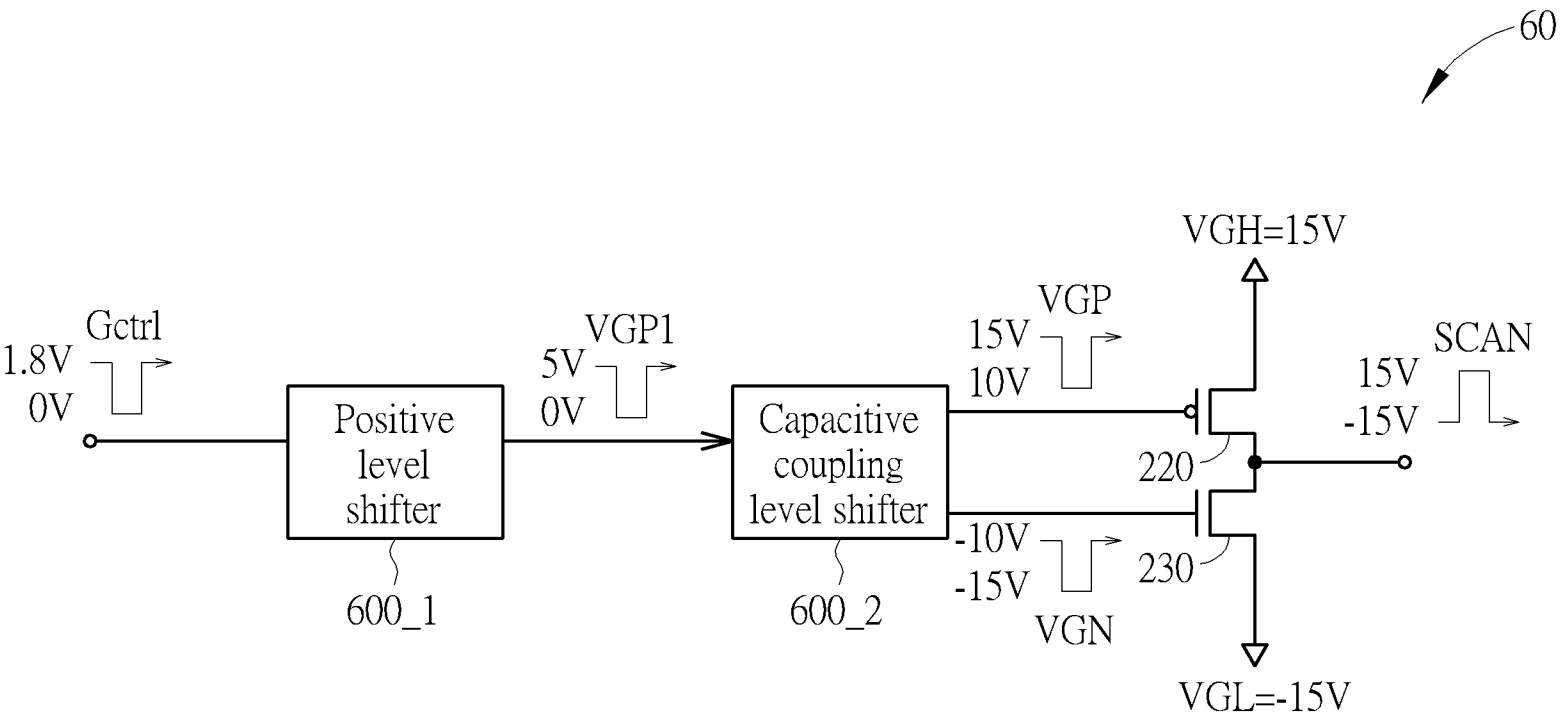
FIG. 6 is a schematic diagram of a gate driving circuit according to an embodiment of the present invention.

For example, please refer to FIG. 6, which is a schematic diagram of a gate driving circuit 60 according to an embodiment of the present invention. The gate driving circuits 60, 20 have the same function, and both can provide the scan signal SCAN to a row of pixel units P(1, y)-P (M, y) on the LCD panel 201. The gate driving circuit 60 is derived from the gate driving circuit 20, and therefore identical components are labeled by the same symbols. In comparison with the gate driving circuit 20, the gate driving circuit 60 features a positive level shifter 600_1 and a capacitive coupling level shifter 600_2. The positive level shifter 600_1 is utilized for shifting up the gate control signal Gctrl to generate a first control signal VGP1. The capacitive coupling level shifter 600_2 is utilized for shifting up the first control signal VGP1 to generate a positive control signal VGP and shifting down the first control signal VGP1 to generate a negative control signal VGN.

Figure 7:
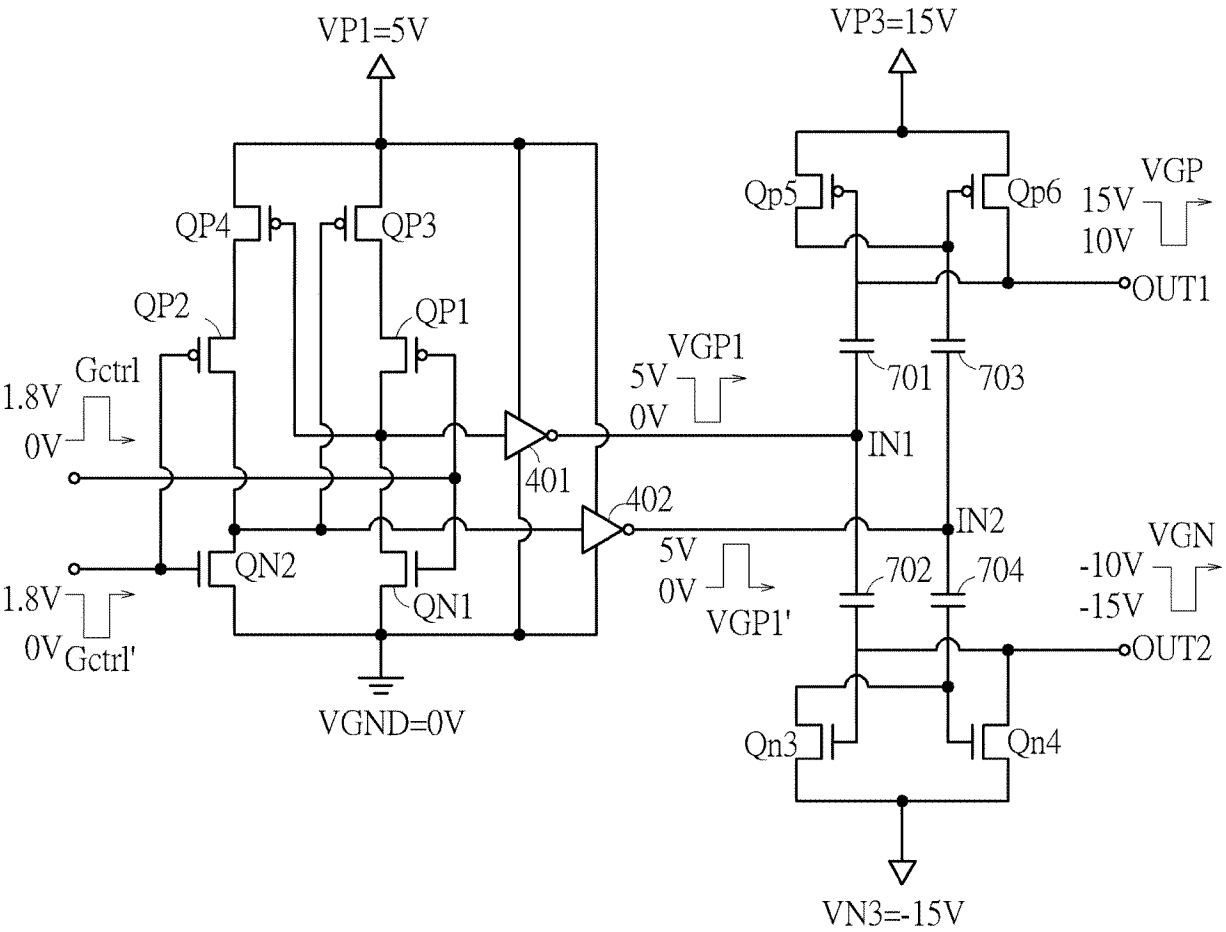
FIG. 7 is a schematic diagram of a positive level shifter and a capacitive coupling level shifter of the gate driving circuit of FIG. 6.

In detail, please refer to FIG. 7, which is a schematic diagram of the positive level shifter 600_1 and the capacitive coupling level shifter 600_2. The positive level shifter 600_1 is derived from the positive level shifter 200_1, and therefore the identical components are labeled by the same symbols. The positive level shifter 600_1 is utilized for shifting up the gate control signal Gctrl of 0/1.8 V to generate the first control signal VGP1 of 0/5 V. Details of the positive level shifter 600_1 can be referred to the description of the positive level shifter 200_1, and are not further narrated herein. The capacitive coupling level shifter 600_2 includes input ends IN1, IN2, output ends OUT1, OUT2, P-type transistors Qp5, Qp6, N-type transistors Qp3, Qp4 and capacitors 701, 702, 703, 704. The input ends IN1, IN2 are utilized for respectively receiving the first control signal VGP1 and an inverted signal VGP1' of the first control signal VGP1. The output ends OUT1, OUT2 are utilized for respectively outputting the positive control signal VGP and the negative control signal VGN.

When the first control signal VGP1 is switched from 0V (logic "0") to 5 V (logic "1"), a gate end of the P-type transistor Qp5 is disabled by a coupling effect of the capacitor 701, a gate end of the N-type transistor Qn3 is enabled by a coupling effect of the capacitor 702, a gate end of the P-type transistor Qp6 is enabled by an coupling effect of the capacitor 703, a gate end of the N-type transistor Qn4 is disabled by a coupling effect of the capacitor 704, the positive control signal VGP is equal to a second power voltage VP3=15 V and represents logic "1", and the negative control signal VGN is equal to −10 V and represents logic "1". On the contrary, when the first control signal VGP1 is switched from 5V (logic "1") to 0 V (logic "0"), the gate end of the P-type transistor Qp5 is enabled by the coupling effect of the capacitor 701, the gate end of the N-type transistor Qn3 is disabled by the coupling effect of the capacitor 702, the gate end of the P-type transistor Qp6 is disabled by the coupling effect of the capacitor 703, the gate end of the N-type transistor Qn4 is enabled by the coupling effect of the capacitor 704, the positive control signal VGP is equal to 10 V and represents logic "0", and the negative control signal VGN is equal to a third power voltage VN3=−15 V and represents logic "0". Therefore, the capacitive coupling level shifter 600_2 can shift up the first control signal VGP1 of 0/5 V to generate the positive control signal VGP of 10/15 V, and can shift down the inverted signal VGP1' of 0/5 V to generate the negative control signal VGN of −15/−10 V.

According to FIG. 6 and FIG. 7, principals of the gate driving circuits 60, 20 are similar, and all component operating voltages of the gate driving circuit 60 are less than 6V and can be implemented all by medium voltage devices.

To sum up, the present invention shifts up the scan signal step by step, such that the high voltage devices of the prior art can be replaced by the medium voltage devices in the gate driving circuit. As a result, the gate driving circuit can be manufactured via cheaper processes so as to reduce the cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A gate driving circuit for providing a scan signal to a LCD panel, the gate driving circuit comprising:

at least one positive level shifter, electrically coupled in series, each for shifting up a gate control signal to generate a positive control signal;

at least one negative level shifter, electrically coupled in series, each for shifting down the gate control signal to generate a negative control signal;

a P-type transistor, comprising: a gate end, electrically coupled to the at least one positive level shifter, for receiving the positive control signal; a source end, for receiving a positive power voltage; and a drain end, electrically coupled to the LCD panel, for outputting the scan signal; and an N-type transistor, comprising: a gate end, electrically coupled to the at least one negative level shifter, for receiving the negative control signal; a source end, for receiving a negative power voltage; and a drain end, electrically coupled to the drain end of the P-type transistor;

wherein an absolute value of a voltage difference between the positive power voltage and the positive control signal is less than a medium voltage device endurance limit;

wherein an absolute value of a voltage difference between the negative power voltage and the negative control signal is less than the medium voltage device endurance limit, wherein the at least one positive level shifter comprises: a first positive level shifter, electrically coupled to a ground and a first power end, for outputting a ground voltage or a first power voltage, wherein an absolute value of a voltage difference between the first power voltage and the ground voltage is less than the medium voltage device endurance limit; and a second positive level shifter, electrically coupled to the first positive level shifter, the first power end and a second power end, for outputting the first power voltage or a second power voltage, wherein an absolute value of a voltage difference between the second power voltage and the first power voltage is less than the medium voltage device endurance limit.

2. The gate driving circuit of claim 1, wherein the first positive level shifter comprises:

a first P-type transistor, comprising:

a gate end, for receiving the gate control signal;

a source end; and a drain end;

a first N-type transistor, comprising:

a gate end, electrically coupled to the gate end of the first P-type transistor, for receiving the gate control signal;

a source end, electrically coupled to the ground end, for receiving the ground voltage; and a drain end, electrically coupled to the drain end of the first P-type transistor;

a second P-type transistor, comprising:

a gate end, for receiving an inverted signal of the gate control signal;

a source end; and a drain end;

a second N-type transistor, comprising:

a gate end, electrically coupled to the gate end of the second P-type transistor, for receiving the inverted signal;

a source end, electrically coupled to the ground end, for receiving the ground voltage; and a drain end, electrically coupled to the drain end of second P-type transistor;

a third P-type transistor, comprising:

a gate end, electrically coupled to the drain end of the second P-type transistor and the drain end of the second N-type transistor;

a source end, electrically coupled to the first power end, for receiving the first power voltage; and a drain end, electrically coupled to the source end of the first P-type transistor;

a fourth P-type transistor, comprising:

a gate end, electrically coupled to the drain end of the first P-type transistor and the drain end of the first N-type transistor;

a source end, electrically coupled to the first power end, for receiving the first power voltage; and a drain end, electrically coupled to the source end of the second P-type transistor;

a first inverter, electrically coupled to the drain end of the first P-type transistor and the drain end of the first N-type transistor, for inverting a first drain voltage of the first P-type transistor and the first N-type transistor to generate a first inverted signal;

a second inverter, electrically coupled to the drain end of the second P-type transistor and the drain end of the second N-type transistor, for inverting a second drain voltage of the second P-type transistor and the second N-type transistor to generate a second inverted signal;

a third N-type transistor, comprising:

a gate end, electrically coupled to the second inverter, for receiving the second inverted signal;

a source end, electrically coupled to the ground end, for receiving the ground voltage; and a drain end; and a fourth N-type transistor, comprising:

a gate end, electrically coupled to the first inverter, for receiving the first inverted signal;

a source end, electrically coupled to the source end of the third N-type transistor and the ground end, for receiving the ground voltage; and a drain end.

3. The gate driving circuit of claim 2, wherein the second positive level shifter comprises:

a fifth P-type transistor, comprising:

a gate end, electrically coupled to the drain end of the fourth N-type transistor;

a source end, electrically coupled to the second power end, for receiving the second power voltage; and a drain end, electrically coupled to the drain end of the third N-type transistor;

a sixth P-type transistor, comprising:

a gate end, electrically coupled to the drain end of the third N-type transistor;

a source end, electrically coupled to the second power end, for receiving the second power voltage; and a drain end, electrically coupled to the drain end of the fourth N-type transistor;

a seventh P-type transistor, comprising:

a gate end, electrically coupled to the drain end of the fifth P-type transistor and the gate end of the sixth P-type transistor;

a source end, electrically coupled to the second power end, for receiving the second power voltage; and a drain end;

an eighth P-type transistor, comprising:

a gate end, electrically coupled to the gate end of the fifth P-type transistor and the drain end of the sixth P-type transistor;

a source end, electrically coupled to the second power end, for receiving the second power voltage; and a drain end;

a fifth N-type transistor, comprising:

a gate end, electrically coupled to the gate end of the seventh P-type transistor, the gate end of the sixth P-type transistor and the drain end of the fifth P-type transistor;

a source end; and a drain end, electrically coupled to the drain end of the seventh P-type transistor;

a sixth N-type transistor, comprising:

a gate end, electrically coupled to the gate end of the eighth P-type transistor, the gate end of the fifth P-type transistor and the drain end of the sixth P-type transistor;

a source end; and a drain end, electrically coupled to the drain end of the eighth P-type transistor;

a seventh N-type transistor, comprising:

a gate end, electrically coupled to the drain end of the eighth P-type transistor and the drain end of the sixth N-type transistor;

a source end, electrically coupled to the first power end, for receiving the first power voltage; and a drain end, electrically coupled to the source end of the fifth N-type transistor;

an eighth N-type transistor, comprising:

a gate end, electrically coupled to the drain end of the seventh P-type transistor and the drain end of the fifth N-type transistor;

a source end, electrically coupled to the first power end, for receiving the first power voltage; and a drain end, electrically coupled to the source end of the sixth N-type transistor;

a third inverter, electrically coupled to the drain end of the eighth P-type transistor, the drain end of the sixth N-type transistor and the gate end of the seventh N-type transistor, for inverting a third drain voltage of the eighth P-type transistor and the sixth N-type transistor to generate a third inverted signal;

a fourth inverter, electrically coupled to the drain end of the seventh P-type transistor, the drain end of the fifth N-type transistor and the gate end of the eighth N-type transistor, for inverting a fourth drain voltage of the seventh P-type transistor and the fifth N-type transistor to generate a fourth inverted signal;

a ninth N-type transistor, comprising:

a gate end, electrically coupled to the third inverter, for receiving the third inverted signal;

a source end, electrically coupled to the first power end, for receiving the first power voltage; and a drain end; and a tenth N-type transistor, comprising:

a gate end, electrically coupled to the fourth inverter, for receiving the fourth inverted signal;

a source end, electrically coupled to the first power end, for receiving the first power voltage; and a drain end.

4. The gate driving circuit of claim 3, further comprising a voltage isolation circuit, electrically coupled between the first positive level shifter and the second positive level shifter, for isolating the ground voltage and the second power voltage, wherein the voltage isolation circuit comprises:

a ninth P-type transistor, comprising:

a gate end, electrically coupled to the first power end, for receiving the first power voltage;

a source end, electrically coupled to the drain end of the fifth P-type transistor; and a drain end, electrically coupled to the first power end, for receiving the first power voltage;

a tenth P-type transistor, comprising:

a gate end, electrically coupled to the first power end, for receiving the first power voltage;

a source end, electrically coupled to the drain end of the sixth P-type transistor; and a drain end, electrically coupled to the first power end, for receiving the first power voltage;

an eleventh N-type transistor, comprising:

a gate end, electrically coupled to the first power end, for receiving the first power voltage;

a source end, electrically coupled to the drain end of the third N-type transistor; and a drain end, electrically coupled to the first power end, for receiving the first power voltage; and a twelfth N-type transistor, comprising:

a gate end, electrically coupled to the first power end, for receiving the first power voltage;

a source end, electrically coupled to the drain end of the fourth N-type transistor; and a drain end, electrically coupled to the first power end, for receiving the first power voltage.

5. The gate driving circuit of claim 1, wherein the at least one negative level shifter comprises:

a first negative level shifter, electrically coupled to a ground end and a third power end, for outputting a ground voltage or a third power voltage, wherein an absolute value of a voltage difference between the ground voltage and the third power voltage is less than the medium voltage device endurance limit; and a second negative level shifter, electrically coupled to the first negative level shifter, the third power end and a fourth power end, for outputting the third power voltage or a fourth power voltage, wherein an absolute value of a voltage difference between the third power voltage and the fourth power voltage is less than the medium voltage device endurance limit.

6. The gate driving circuit of claim 5, wherein the medium voltage device endurance limit is 6 V.

7. The gate driving circuit of claim 5, wherein the first negative level shifter comprises:

a first P-type transistor, comprising:

a gate end, for receiving the gate control signal;

a source end, electrically coupled to the ground end, for receiving the ground end; and a drain end;

a first N-type transistor, comprising:

a gate end, electrically coupled to the gate end of the first P-type transistor, for receiving the gate control signal;

a source end; and a drain end, electrically coupled to the drain end of the first P-type transistor;

a second P-type transistor, comprising:

a gate end, for receiving an inverted signal of the gate control signal;

a source end, electrically coupled to the ground end, for receiving the ground end; and a drain end;

a second N-type transistor, comprising:

a gate end, electrically coupled to the gate end of the second P-type transistor, for receiving the inverted signal;

a source end; and a drain end, electrically coupled to the drain end of the second P-type transistor;

a third N-type transistor, comprising:

a gate end, electrically coupled to the drain end of the second P-type transistor and the drain end of the second N-type transistor;

a source end, electrically coupled to the first power end, for receiving the first power voltage; and a drain end, electrically coupled to the source end of the first N-type transistor;

a fourth N-type transistor, comprising:

a gate end, electrically coupled to the drain end of the first P-type transistor and the drain end of the first N-type transistor;

a source end, electrically coupled to the first power end, for receiving the first power voltage; and a drain end, electrically coupled to the source end of the second N-type transistor;

a first inverter, electrically coupled to the drain end of the first P-type transistor and the drain end of the first N-type transistor, for inverting a first drain voltage of the first P-type transistor and the first N-type transistor to generate a first inverted signal;

a second inverter, electrically coupled to the drain end of the second P-type transistor and the drain end of the second N-type transistor, for inverting a second drain voltage of the second P-type transistor and the second N-type transistor to generate a second inverted signal;

a third P-type transistor, comprising:

a gate end, electrically coupled to the second inverter, for receiving the second inverted signal;

a source end; and a drain end; and a fourth P-type transistor, comprising:

a gate end, electrically coupled to the first inverter, for receiving the first inverted signal;

a source end, electrically coupled to the source end of the third P-type transistor; and a drain end.

8. The gate driving circuit of claim 7, wherein the second negative level shifter comprises:

a fifth N-type transistor, comprising:

a gate end, electrically coupled to the drain end of the fourth P-type transistor;

a source end, electrically coupled to the second power end, for receiving the second power voltage; and a drain end, electrically coupled to the drain end of the third P-type transistor;

a sixth N-type transistor, comprising:

a gate end, electrically coupled to the drain end of the third P-type transistor;

a source end, electrically coupled to the second power end, for receiving the second power voltage; and a drain end, electrically coupled to the drain end of the fourth P-type transistor;

a seventh N-type transistor, comprising:

a gate end, electrically coupled to the gate end of the sixth N-type transistor and the drain end of the fifth N-type transistor;

a source end, electrically coupled to the second power end, for receiving the second power voltage; and a drain end;

an eighth N-type transistor, comprising:

a gate end, electrically coupled to the gate end of the fifth N-type transistor and the drain end of the sixth N-type transistor;

a source end, electrically coupled to the second power end, for receiving the second power voltage; and a drain end;

a fifth P-type transistor, comprising:

a gate end, electrically coupled to the gate end of the seventh N-type transistor;

a source end; and a drain end, electrically coupled to the drain end of the seventh N-type transistor;

a sixth P-type transistor, comprising:

a gate end, electrically coupled to the gate end of the eighth N-type transistor;

a source end; and a drain end, electrically coupled to the drain end of the eighth N-type transistor;

a seventh P-type transistor, comprising:

a gate end, electrically coupled to the drain end of the sixth P-type transistor;

a source end, electrically coupled to the first power end, for receiving the first power voltage; and a drain end, electrically coupled to the source end of the fifth P-type transistor;

an eighth P-type transistor, comprising:

a gate end, electrically coupled to the drain end of the fifth P-type transistor;

a source end, electrically coupled to the first power end, for receiving the first power voltage; and a drain end, electrically coupled to the source end of the sixth P-type transistor;

a third inverter, electrically coupled to the drain end of the fifth P-type transistor and the drain end of the seventh N-type transistor, for inverting a third drain voltage of the fifth P-type transistor and the seventh N-type transistor to generate a third inverted signal;

a fourth inverter, electrically coupled to the drain end of the sixth P-type transistor and the drain end of the eighth N-type transistor, for inverting a fourth drain voltage of the sixth P-type transistor and the eighth N-type transistor to generate a fourth inverted signal;

a ninth P-type transistor, comprising:

a gate end, electrically coupled to the fourth inverter, for receiving the fourth inverted signal;

a source end; and a drain end; and a tenth P-type transistor, comprising:

a gate end, electrically coupled to the third inverter, for receiving the third inverted signal;

a source end, electrically coupled to the source end of the ninth P-type transistor; and a drain end.

9. The gate driving circuit of claim 8, further comprising a voltage isolation circuit, electrically coupled between the first negative level shifter and the second negative level shifter, for isolating the ground voltage and the second power voltage, wherein the voltage isolation circuit comprises:

a ninth N-type transistor, comprising:

a gate end, electrically coupled to the first power end, for receiving the first power voltage;

a source end, electrically coupled to the drain end of the fifth N-type transistor; and a drain end, electrically coupled to the first power end, for receiving the first power voltage;

a tenth N-type transistor, comprising:

a gate end, electrically coupled to the first power end, for receiving the first power voltage;

a source end, electrically coupled to the drain end of the sixth N-type transistor; and a drain end, electrically coupled to the first power end, for receiving the first power voltage;

an eleventh P-type transistor, comprising:

a gate end, electrically coupled to the first power end, for receiving the first power voltage;

a source end, electrically coupled to the drain end of the third P-type transistor; and a drain end, electrically coupled to the first power end, for receiving the first power voltage; and a twelfth P-type transistor, comprising:

a gate end, electrically coupled to the first power end, for receiving the first power voltage;

a source end, electrically coupled to the drain end of the fourth P-type transistor; and a drain end, electrically coupled to the first power end, for receiving the first power voltage.

10. The gate driving circuit of claim 1, wherein the medium voltage device endurance limit is 6 V.

11. A display module, comprising:

an LCD panel; and a gate driving circuit, for providing a scan signal to the LCD panel, wherein the gate driving circuit comprises:

at least one positive level shifter, electrically coupled in series, each for shifting up a gate control signal to generate a positive control signal;

at least one negative level shifter, electrically coupled in series, each for shifting down the gate control signal to generate a negative control signal;

a P-type transistor, comprising: a gate end, electrically coupled to the at least one positive level shifter, for receiving the positive control signal; a source end, for receiving a positive power voltage; and a drain end, electrically coupled to the LCD panel, for outputting the scan signal; and an N-type transistor, comprising: a gate end, electrically coupled to the at least one negative level shifter, for receiving the negative control signal; a source end, for receiving a negative power voltage; and a drain end, electrically coupled to the drain end of the P-type transistor;

wherein an absolute value of a voltage difference between the positive power voltage and the positive control signal is less than a medium voltage device endurance limit;

wherein an absolute value of a voltage difference between the negative power voltage and the negative control signal is less than the medium voltage device endurance limit, wherein the at least one positive level shifter comprises: a first positive level shifter, electrically couple to a ground and a first power end, for outputting a ground voltage or a first power voltage, wherein an absolute value of a voltage difference between the first power voltage and the ground voltage is less than the medium voltage device endurance limit; and a second positive level shifter, electrically coupled to the first positive level shifter, the first power end and a second power end, for outputting the difference between the second power voltage and the first power voltage is less than the medium voltage device endurance limit.

12. The display module of claim 11, wherein the medium voltage device endurance limit is 6 V.

* * * * *